US007546072B2

(12) United States Patent
Saeki

(10) Patent No.: US 7,546,072 B2
(45) Date of Patent: Jun. 9, 2009

(54) TONER LAYER THICKNESS REGULATION MEMBER AND IMAGE FORMING APPARATUS HAVING SAME

(75) Inventor: Satoshi Saeki, Yokohama (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 11/873,587

(22) Filed: Oct. 17, 2007

(65) Prior Publication Data

US 2008/0095555 A1 Apr. 24, 2008

(30) Foreign Application Priority Data

Oct. 17, 2006 (JP) ..... 2006-282459
Oct. 11, 2007 (JP) ..... 2007-265625

(51) Int. Cl.
*G03G 15/08* (2006.01)

(52) U.S. Cl. ..... 399/284; 399/274

(58) Field of Classification Search ..... 399/284, 399/274

See application file for complete search history.

(56) References Cited

U.S. PATENT DOCUMENTS 5,177,323 A * 1/1993 Kohyama ..... 399/222
5,768,670 A * 6/1998 Enomoto et al. ..... 399/284
5,893,013 A * 4/1999 Kinoshita et al. ..... 399/284
2005/0063722 A1* 3/2005 Yoshizawa et al. ..... 399/53

FOREIGN PATENT DOCUMENTS

JP 04317084 A * 11/1992
JP 2005274646 A 10/2005

* cited by examiner

*Primary Examiner*—Quana M Grainger
(74) *Attorney, Agent, or Firm*—Sughrue Mion, PLLC

(57) ABSTRACT

There is provided according to the present invention a toner layer thickness regulation member capable of suppressing uneven density during forming an image. There is also provided an image forming apparatus capable of forming an excellent image stably by employing such a toner layer thickness regulation member. A toner layer thickness regulation member 1 has a strip metal plate 2 and an elastic member 3 provided in one side of the metal plate 2 in a width direction and arranged in parallel to a longitudinal direction of the metal plate, wherein the elastic member 3 has hardness of more than 55° and hardness relaxation of less than 2.6°. In addition, an image forming apparatus employs the above-mentioned toner layer thickness regulation member 1.

6 Claims, 2 Drawing Sheets

TONER LAYER THICKNESS REGULATION MEMBER AND IMAGE FORMING APPARATUS HAVING SAME

BACKGROUND OF THE INVENTION

1. Field of the Invention

The present invention relates to a toner layer thickness regulation member and an image forming apparatus having same, and particularly relates to a toner layer thickness regulation member capable of suppressing uneven density generated during forming an image.

2. Description of Related Art

Generally, in a electrographic image forming apparatus such as a copying machine, a facsimile machine, a laser beam printer (LBP) and so on, a pressure developing method is known as a developing method in which toner (developer) is applied to a photoconductive drum holding a latent image thereon and then the toner is attached to the latent image of the photoconductive drum to visualize the latent image. In the pressure developing method, development is performed in such a manner that, for example, a photoconductive drum is charged in a certain electric potential, an electrostatic latent image is formed on the photoconductive drum by an exposure device, and a developing roller supporting toner is brought into contact with the photoconductive drum holding the electrostatic latent image to attach the toner to the latent image of the photoconductive drum.

In the above-mentioned pressure developing method, in order to obtain an excellent image, it is important to adjust the amount of the toner supported on the outer circumference of the developing roller and the toner charge as desired. To this end, a toner layer thickness regulation member is frequently used which controls the amount of the toner supplied to the photoconductive drum by regulating the thickness of the toner layer supported on the outer circumference of the developing roller and adjusts the toner charge by frictionally charging the toner. Such a toner layer thickness regulation member generally has a metal plate which is supportedly mounted in one side in the width direction to neighbor the circumferential surface of the developing roller, and an elastic member arranged in the other side in the width direction of the metal plate (see, for example, JP 2005-274646 A).

SUMMARY OF THE INVENTION

However, when a conventional toner layer thickness regulation member is used in an image forming apparatus, toner is sometimes adhered to a part of an elastic member constituting the toner layer thickness regulation member, thereby, flow of the toner may be blocked in that part. Therefore, there is a problem that in the course of attaching the toner supported by the developing roller to a latent image of the photoconductive drum, the supply amount of the toner is partially reduced so that uneven density is generated in a printed image.

Therefore, it is an object of the present invention to solve the above-mentioned conventional problem and to provide a toner layer thickness regulation member capable of suppressing uneven density during forming an image. Also, it is another object of the present invention to provide an image forming apparatus capable of stably forming an excellent image by employing such a toner layer thickness regulation member.

The inventor has tried to achieve the above-mentioned objects and found that the toner is prevented from being adhered to the toner layer thickness regulation member by applying an elastic member having certain hardness and hardness relaxation for the toner layer thickness regulation member. From this result, the inventor comes up with an idea that the toner layer thickness regulation member suppressing uneven density during forming an image may be obtained with using such an elastic member and eventually completes the present invention.

That is, a toner layer thickness regulation member of the present invention has a strip metal plate and an elastic member provided in one side of the metal plate in a width direction and arranged in parallel to a longitudinal direction of the metal plate, wherein the elastic member has hardness of more than 55° and hardness relaxation of less than 2.6°.

In the toner layer thickness regulation member of the present invention, the elastic member preferably has hardness of more than 70°.

In the toner layer thickness regulation member of the present invention, the elastic member preferably has hardness of more than 65° and hardness relaxation of less than 2.0°.

In the toner layer thickness regulation member of the present invention, the elastic member preferably has hardness of more than 55° and hardness relaxation of less than 1.2°.

In the toner layer thickness regulation member of the present inventions the elastic member preferably has hardness of less than 85°.

In addition, an image forming apparatus of the present invention employs the above-mentioned toner layer thickness regulation member.

According to the present invention, it is possible to provide a toner layer thickness regulation member capable of suppressing uneven density during forming an image by employing an elastic member having certain hardness and hardness relaxation in the toner layer thickness regulation member. Also, it is possible to provide an image forming apparatus capable of forming an excellent image stably by employing such a toner layer thickness regulation member.

DESCRIPTION OF THE PREFERRED EMBODIMENTS

<Toner Layer Thickness Regulation Member>

Figure 1:
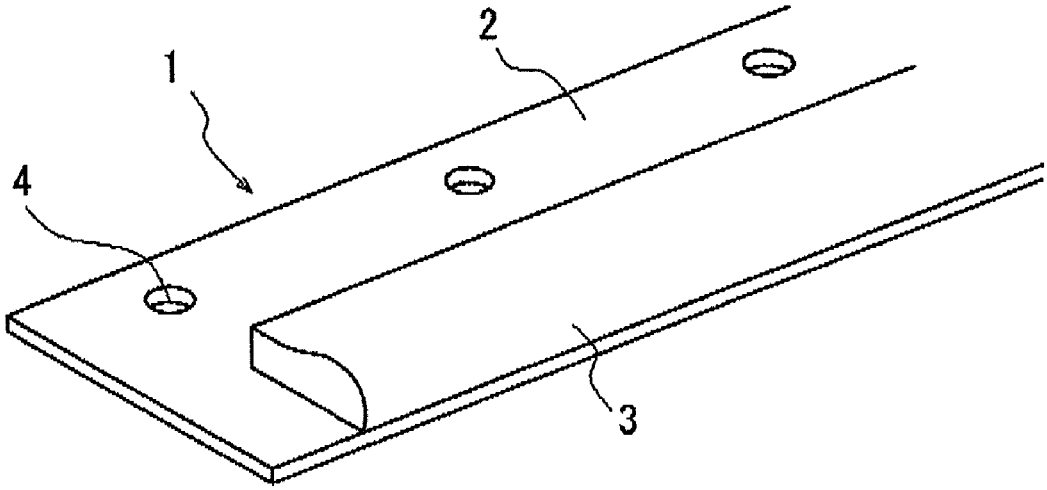
FIG. 1 is a partial perspective view of an example of a toner layer thickness regulation member according to the present invention.
Figure 2:
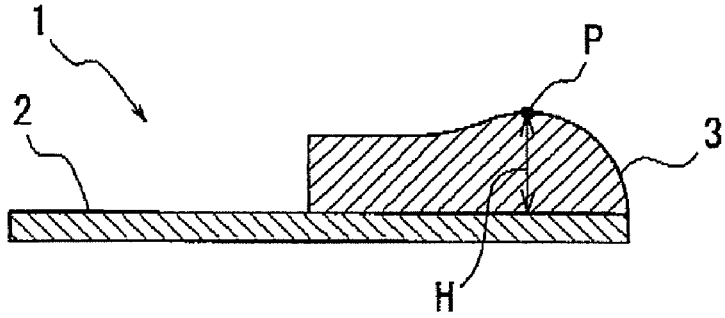
FIG. 2 is a sectional view in a width direction of an example of a developer control quantity blade according to the present invention.

Hereinafter, a toner layer thickness regulation member according to the present invention will be described in detail with reference to the attached drawings. FIG. 1 is a partial perspective view of an example of a toner layer thickness regulation member according to the present invention. FIG. 2 is a sectional view in a width direction of an example of a developer control quantity blade according to the present invention.

A toner layer thickness regulation member 1 shown in FIG. 1 has a strip metal plate 2 which is supportedly mounted in one side in the width direction, and an elastic member 3 provided in the other side of the metal plate 2 in the width direction and arranged in parallel to the longitudinal direction of the metal plate 2. In addition, in the toner layer thickness regulation member of the present invention, an adhesive agent may be applied between the metal plate 2 and the elastic member 3, although they are not illustrated in the figure.

The metal plate constituting the toner layer thickness regulation member of the present invention is not particularly limited, as long as it is in a strip shape, but, in order to balance plasticity and hardness required for the metal plate, a thin plate having a thickness between 0.05 and 0.5 mm is preferably used for the metal plate. As material of such metal plate, aluminum, stainless, copper and so on can be preferably used. Although the illustrative metal plate 2 has a plurality of mounting holes 4, the mounting hole in the toner layer thickness regulation member of the present invention is not limited as long as it is used for mounting the toner layer thickness regulation member 1 in a holder of an image forming apparatus.

The elastic member constituting the toner layer thickness regulation member of the present invention preferably has a cross sectional shape of a smooth convex shape as shown in, for example, FIG. 1, so that the elastic member is arranged to elastically contact a developing roller of an image forming apparatus in a mounted position where the toner layer thickness regulation member is mounted in the image forming apparatus.

In addition, in the toner layer thickness regulation member 1 shown in FIG. 2, a central point P of the contact surface elastically contacting the developing roller when the toner layer thickness regulation member 1 is mounted in the image forming apparatus is positioned on a crown portion of the smooth convex shape of the elastic member 3. A height H from the metal plate 2 to the central position P of the contact surface elastically contacting the developing roller is preferably within a range between 0.1 and 5.0 mm and more preferably within a range between 0.5 and 3.0 mm. When the height H is less than 0.1 mm, the displacement from the natural length is so small that the elastic member may not function as an elastic body. On the other hand, when the height H is more than 5.0 mm, the image forming apparatus increases in size.

The toner layer thickness regulation member of the present invention is characterized in that the above-mentioned elastic member has hardness of more than 55° and hardness relaxation of less than 2.6°. In general, in an image forming apparatus employing a toner layer thickness regulation member having an elastic member with low hardness, when toner passes between the developing roller and the toner layer thickness regulation member, the elastic member is largely deformed. In addition, if hardness relaxation of the elastic member is large, the deformation is not restored and the toner remains in thus-deformed portion, which results in uneven density. However, in the toner layer thickness regulation member of the present invention, the elastic member has hardness of more than 55° and hardness relaxation of less than 2.6° so that the deformation of the elastic member is slight and its restoring force is large. As a result, the toner is prevented from adhering to the elastic member. Therefore, the toner layer thickness regulation member of the present invention has an elastic member, which is slightly deformed and has large restoring force for the deformation. When such a toner layer thickness regulation member is used in an image forming apparatus, the adhering of the toner to the toner layer thickness regulation member is significantly reduced so that uneven density generated in forming an image can be suppressed.

The elastic member constituting the toner layer thickness regulation member of the present invention has hardness of essentially more than 55°, preferably more than 65° and more preferably more than 70° as well as preferably less than 85°.

In order to define product hardness of a blade having a modest curved surface, the hardness is measured with a micro hardness meter MD-1 manufactured by Kobunshi Keiki Co., Ltd. in the following way. A cylindrical probe provided in a main body and having a height of 0.5 mm and a diameter of 1.6 mm is arranged perpendicular to the metal plate having a thickness of 0.1 mm, abutted against the peak of the elastic member having a convex shape, and pushed into the elastic member by 0.5 mm at a speed of 8 mm/sec to measure a peak value of a deformation of a spring. The reaction force of the spring is 22 mN at 0 point where the probe is not pushed at all and the reaction force is 332 mN at 100 point where the probe is completely pushed into the main body. The peak values are measured at five points along the longitudinal direction of the elastic member and averaged to give hardness of the blade.

When the hardness is more than 55°, deformation of the elastic member due to the toner is small so that the toner can be prevented from adhering to the elastic member. Further, the hardness is preferably more than 65° and more preferably more than 70°. When the hardness is more than 65° and preferably more than 70°, a pressure contact width between the developing roller and the elastic member is reduced so that stained level of the developing roller can be reduced. On the other hand, when the hardness is 85° or more, stiffness of the elastic member is excessively high, higher than that of the metal plate, so that the elastic member contracts and becomes smaller than the metal plate during the molding to suffer warping. This hardness can be adjusted by appropriately selecting constituents, compositions and so on contained in the above-mentioned elastic member.

The micro hardness meter MD-1 manufactured by Kobunshi Keiki Co., Ltd. will be described with reference to FIG. 3.

The micro hardness meter MD-1 is a full automatic micro hardness meter capable of directly and quickly measuring small rubber parts and rubber sheets having a thickness between 1 and 2 mm. The micro hardness meter MD-1 enables direct measurement of "hardness of objects themselves" with higher reproducibility, which has been considered difficult for conventional hardness meters.

Figure 3:
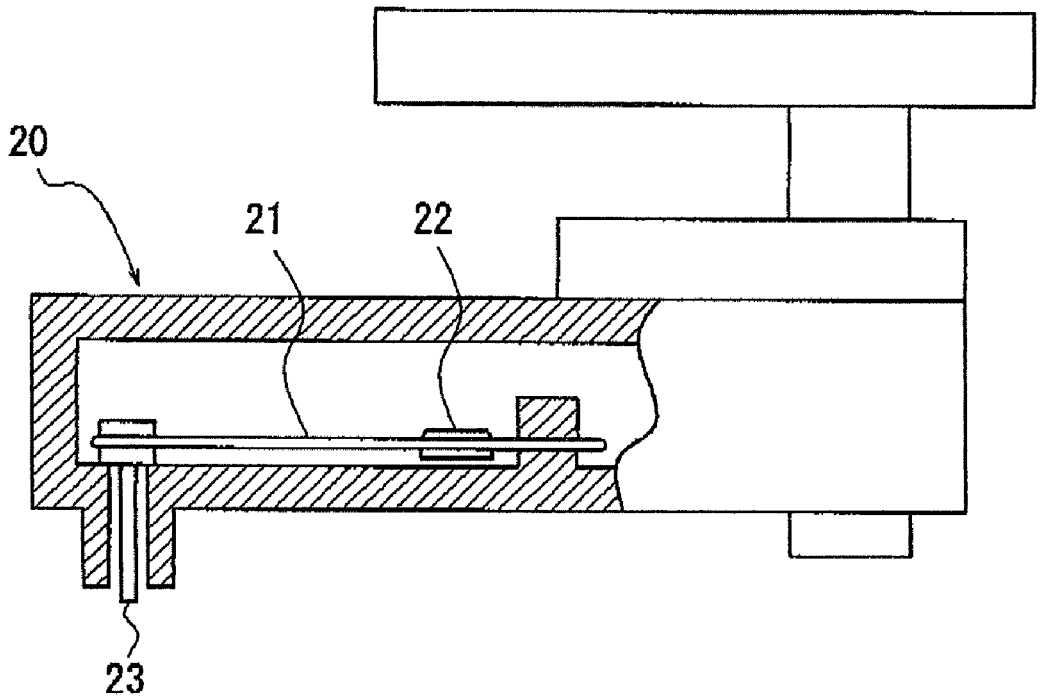
FIG. 3 is a view showing a basic structure of a sensor part of a micro hardness meter MD-1.

FIG. 3 shows a basic structure of a sensor part of the micro hardness meter MD-1. In a main body casing 20 of the sensor part of the micro hardness meter MD-1, there is provided a leaf spring 21, a displacement sensor 22 integrated with the leaf spring 21 and a probe 23 connected to the leaf spring 21. The cantilever structure of the leaf spring 21 eliminates mechanical contacting portions (e.g. bearings, gears and the like) and realizes high-precision micro loading. In addition, integrating the leaf spring 21 and the displacement sensor 22, which are used to apply a load to a head of the probe 23, can simplify the structure.

The above-mentioned micro hardness meter MD-1 is abutted against an object to measure the amount of the probe 23 entered into the main body casing 20.

The elastic member constituting the toner layer thickness regulation member of the present invention has hardness relaxation of essentially less than 2.6°, preferably less than 2.0° and more preferably less than 1.2°. The hardness relaxation is measured with the micro hardness meter MD-1 manufactured by Kobunshi Keiki Co., Ltd. in the following way. That is, hardness is measured by the above-mentioned method, hardness is then measured again after the probe is further kept abutting for 90 seconds, the differences of the former hardness and the latter hardness are obtained at five points along the longitudinal direction of the elastic member, and five of thus-obtained differences are averaged to give the hardness relaxation of the blade. When the hardness relaxation is less than 2.6°, restoring force of the elastic member is large as compared to its deformation and thus the toner can be prevented from adhering to the elastic member. In addition, when the hardness relaxation is less than 2.0° and more preferably less than 1.2°, regardless of printing speed during forming an image, uneven density can be suppressed. This hardness relaxation can be adjusted by appropriately selecting constituents, compositions and so on contained in the above-mentioned elastic member.

For the reasons described above, an elastic member having hardness of more than 70° and hardness relaxation of less than 2.6°, an elastic member having hardness of more than 90° and hardness relaxation of less than 2.0° and an elastic member having hardness of more than 55° and hardness relaxation of less than 1.20 can be cited as a preferable elastic member constituting the toner layer thickness regulation member of the present invention, by way of example. In addition, the elastic member having the above-specified hardness and hardness relaxation preferably has the hardness of less than 85°.

The elastic member constituting the toner layer thickness regulation member of the present invention is not particularly limited, as long as it has the specified hardness and hardness relaxation, but is obtained, for example, by heat-curing a material for an elastic member containing silicone rubber and other optional material such as a cross-linker and a reinforcing filler.

The silicone rubber used for the above-mentioned material for the elastic member is a compound having a main chain with a plurality of siloxane bonds (—SiO—). As the silicone rubber, milable silicone rubber is preferably used and liquid silicone rubber is more preferably used. As the silicone rubber, specifically, dimethylsilicone, methylvinylsilicone, methylphenylsilicone, fluorosilicone and the like may be cited.

The cross-linker usable in the above-mentioned material for the elastic member is a compound which have reactive functional groups and serves to react with silicone rubber having functional groups such as a vinyl group, a hydroxyl group, a methyl group and the like and cross-link thus-formed rubber molecules to form a three dimensional network structure. In the toner layer thickness regulation member of the present invention, by increasing the number of the functional groups of silicone rubber and the content and number of the functional groups of the cross-linker in the material for the elastic member, crosslink density of the elastic member can be increased and, as a result, the elastic member having excellent hardness and hardness relaxation can be obtained. As the cross-linker, organic peroxide, hydrogen polysiloxane (polysiloxane having a hydrogen atom coupled to a silicon atom in a molecule) and the like may be cited. Generally, single kind of the above-mentioned cross-linker may be used, however two or more kinds may be used in combination.

As the reinforcing filler usable in the above-mentioned material for the elastic member, silica, silicone resin and the like may be cited and, among others, silica is preferable. As the silica, precipitated silica is preferably used and fumed silica is more preferably used. Single kind of the above-mentioned filling agent for reinforcement may be used and two or more kinds may be used in combination as well.

The compounding ratio of the reinforcing filler used for the above-mentioned material for the elastic member is preferably not more than 100 per hundred rubber with respect to 100 weight part of the above-mentioned silicone rubber. When the compounding ratio of the reinforcing filler is more than 100 per hundred rubber, hardness is excessively high and viscosity is excessively increased so that the reinforcing filler cannot be blended with the silicone rubber.

The toner layer thickness regulation member of the present invention can be manufactured in such a manner that the above-mentioned material for the elastic member is injected into a cavity of a mold, in which the above-mentioned metal plate is arranged, and the elastic member is integrally molded on the metal plate by a known molding method. As a known molding method, a transfer molding method, an injection molding method, a Liquid Injection Molding method and the like may be cited by way of example and, among others, a Liquid Injection Molding method is preferably used.

<Image Forming Apparatus>

An image forming apparatus of the present invention is characterized in that it employs the above-mentioned toner layer thickness regulation member. The image forming apparatus of the present invention is not particularly limited as long as it employs the above-mentioned toner layer thickness regulation member, and may be produced by a known method.

Figure 4:
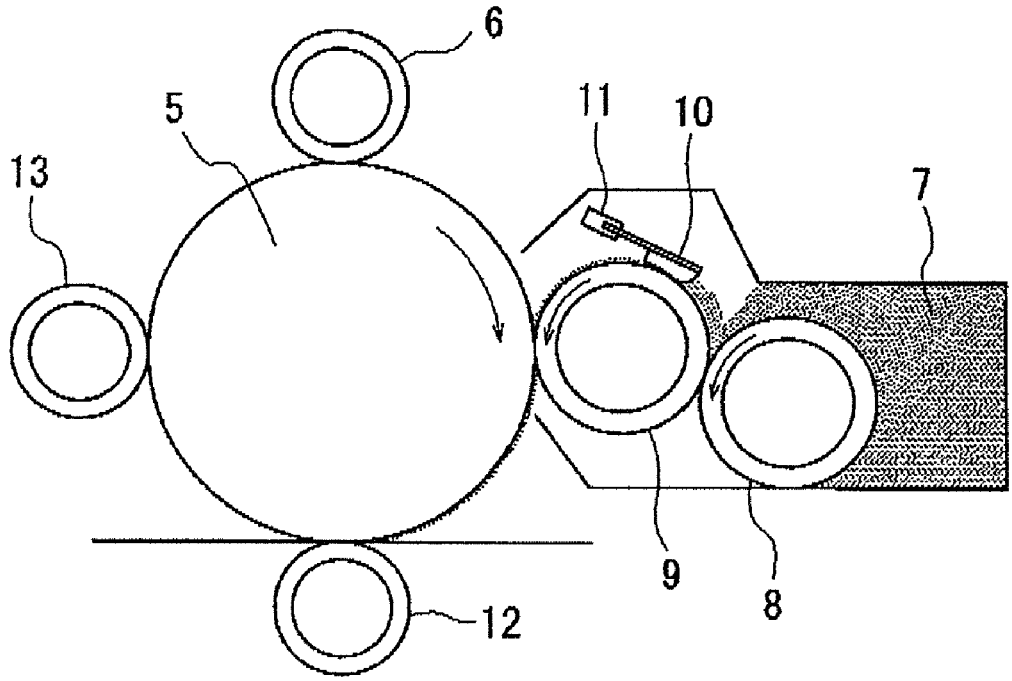
FIG. 4 is a partial sectional view of an example of an image forming apparatus according to the present invention.

Hereinafter, an image forming apparatus according to the present invention will be described in detail with reference to FIG. 4. FIG. 4 is a partial sectional view of an example of an image forming apparatus according to the present invention. The illustrative image forming apparatus has a photo conductor 5 holding a latent image thereon, a charging roller 6 arranged near (upside in the figure) the photo conductor 5 for charging the photo conductor 5, a toner applying roller 8 for applying toner 7, a developing roller 9 arranged between the toner applying roller 8 and the photo conductor 5, a toner layer thickness regulation member 10 arranged near the outer circumference of the developing roller 9 for adjusting the applying amount of the toner and the toner charge, a holder 11 arranged for supporting the toner layer thickness regulation member 10, a transfer roller 12 arranged near (downside in the figure) the photo conductor 5, and a cleaning roller 13 arranged near the photo conductor 5. The image forming apparatus of the present invention may further have known parts (not shown) which are generally used in an image forming apparatus.

In the illustrative image forming apparatus, the charging roller 6 is brought into contact with the photo conductor 5 and voltage is applied between the photo conductor 5 and the charging roller 6 to charge the photo conductor 5 in a certain electric potential, thereafter, an electrostatic latent image is formed on the photo conductor 5 by an exposure device (not shown). Next, the photo conductor 5, the toner applying roller 8 and the developing roller 9 are rotated in the directions as shown by the arrows in the figure so that the toner 7 on the toner applying roller 8 is carried to the photo conductor 5 via the developing roller 9. The toner 7 on the developing roller 9 is adjusted to be an even thin layer with the toner charge being adjusted by means of the toner layer thickness regulation member 10. Since the developing roller 9 and the photo conductor 5 are rotated while contacting with each other, the toner 7 is attached to the latent image of the photo conductor 5 to visualize the latent image. The toner 7 attached to the latent image is transferred to a recording medium such as paper by the transfer roller 12. The toner 7 remaining on the photo conductor 5 after transfer is removed by the cleaning roller 13. In the image forming apparatus of the present invention, by using the above-mentioned toner layer thickness regulation member of the present invention for the toner layer thickness regulation member 10, it is possible to stably form an excellent image.

EXAMPLES

Hereinafter, the present invention will be further described in detail with reference to embodiments, however, the present invention is not limited to the following embodiments.

A toner layer thickness regulation member is produced, which employs an elastic member having the hardness and hardness relaxation shown in Table 1 and the structure shown in FIG. 1, in such a manner that material for the elastic member is injected into a cavity of a mold provided with a strip metal plate having a thickness of 0.1 mm and made of stainless steel and then heat-cured by means of a Liquid Injection Molding method. A height from the metal plate of the obtained toner layer thickness regulation member to the central position of the contact surface elastically contacting the developing roller is 1.5 mm.

Next, in the obtained toner layer thickness regulation member, hardness and hardness relaxation are measured and, in addition, evaluation for uneven density and evaluation for stained levels of the developing roller are performed in the following method. The results are shown in Table 1.

(1) Hardness

The hardness is measured with a micro hardness meter MD-1 manufactured by Kobunshi Keiki Co., Ltd. in such a manner that a probe is arranged perpendicularly to a metal plate having a thickness of 0.1 mm and abutted against the peak of the elastic member having a convex shape, the hardness is measured at five points along the longitudinal direction of the elastic member, and their average is calculated for evaluation. Some of elastic members having the hardness not less than 85° suffer warping during the repetition of the experimental production, therefore, they are rejected from the evaluation.

(2) Hardness Relaxation

The hardness relaxation is measured with the micro hardness meter MD-1 manufactured by Kobunshi Keiki Co., Ltd. in such a manner that the probe is arranged perpendicularly to the metal plate having a thickness of 0.1 mm and abutted against the peak of the elastic member having a convex shape for 90 seconds, and differences between the peak values of the hardness during the 90 second period and the a value of hardness at 90 seconds is measured at five points along the longitudinal direction of the elastic member and their average is calculated for evaluation.

In this example, although hardness relaxation of less than 0.9° is not realized, it is obvious that a value closer to 0° is more preferable from the above description.

(3) Evaluation for Uneven Density

The toner layer thickness regulation member is mounted in a cartridge. Then, an image is printed to perform visual inspection. The results are shown in Table 1. In the table, examples without uneven density are marked as "Pass" and examples with uneven density are marked as "Fail". The evaluation is performed for two different kinds of printing speed.

(4) Evaluation for Stained Level of the Developing Roller

The toner layer thickness regulation member and the developing roller are mounted in a cartridge and left for 30 days. Then, an image is printed to perform visual inspection. The results are shown in Table 1. In the table, examples without stain are marked as "Pass", an example with slight stain is marked as "Middle" and an example with stain are marked as "Fail".

TABLE 1

| | Comparative Example 1 | Comparative Example 2 | Example 1 | Example 2 | Example 3 | Example 4 | Example 5 | Example 6 |
|---|---|---|---|---|---|---|---|---|
| Hardness (°) | 74 | 51 | 73 | 68 | 58 | 65 | 65 | 56 |
| Hardness relaxation (°) | 2.7 | 0.9 | 1.9 | 2.1 | 1.1 | 1.8 | 1.3 | 2.5 |
| Evaluation for uneven density (Printing speed: slow) | Fail | Fail | Pass | Pass | Pass | Pass | Pass | Pass |
| Evaluation for uneven density (Printing speed: fast) | Fail | Fail | Pass | Fail | Pass | Fail | Pass | Fail |
| Evaluation for strain of developing roller | Pass | Fail | Pass | Middle | Fail | Fail | Fail | Fail |

It is appreciated from Table 1 that the toner layer thickness regulation members of Examples equipped with the elastic member having hardness of more than 55° and hardness relaxation of less than 2.6° are improved in the generation of uneven density in comparison to the toner layer thickness regulation members of Comparative Examples. It is also appreciated that the toner layer thickness regulation members of Examples 1, 3 and 5 are equipped with the elastic member having either of higher hardness or lower hardness relaxation, so that the generation of uneven density can be suppressed independently of the printing speed. In addition, it is appreciated that the toner layer thickness regulation members of Examples 1 and 2 are equipped with the elastic member having higher hardness, so that the stain level of the developing roller can be improved.

What is claimed is:

1. A toner layer thickness regulation member comprising:

a strip metal plate; and an elastic member provided in one side of the metal plate in a width direction and arranged in parallel to a longitudinal direction of the metal plate, wherein the elastic member has hardness of more than 55° and hardness relaxation of less than 2.60.

2. The toner layer thickness regulation member according to claim 1, wherein the elastic member has hardness of more than 70°.

3. The toner layer thickness regulation member according to claim 1, wherein the elastic member has hardness of more than 65° and hardness relaxation of less than 2.0°.

4. The toner layer thickness regulation member according to claim 1, wherein the elastic member has hardness of more than 55° and hardness relaxation of less than 1.2°.

5. The toner layer thickness regulation member according to claim 1, wherein the elastic member has hardness of less than 85.

6. An image forming apparatus, wherein the toner layer thickness regulation member according to claim 1 is used.

* * * * *